US009114897B2

(12) United States Patent
Kim et al.

(10) Patent No.: US 9,114,897 B2
(45) Date of Patent: Aug. 25, 2015

(54) AUTOMATIC PACKING APPARATUS AND AUTOMATIC PACKING METHOD USING THE SAME

(75) Inventors: Jin Ho Kim, Yongin-si (KR); Byoung Oh Park, Suwon-si (KR); Yong Ki Cho, Suwon-si (KR); Jong Soo Jeong, Hwaseong-si (KR); Bong Sup Lim, Suwon-si (KR); Yun Jin Jung, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 894 days.

(21) Appl. No.: 13/253,229

(22) Filed: Oct. 5, 2011

(65) Prior Publication Data

US 2012/0079796 A1 Apr. 5, 2012

(30) Foreign Application Priority Data

Oct. 5, 2010 (KR) ..... 10-2010-0097063

(51) Int. Cl.
*B65B 3/12* (2006.01)
*B65B 5/02* (2006.01)
(Continued)

(52) U.S. Cl.
CPC ..... *B65B 43/265* (2013.01); *B65B 5/024* (2013.01); *B65B 43/285* (2013.01)

(58) Field of Classification Search
CPC ..... B65B 11/12; B65B 11/004; B65B 5/02; B65B 5/024; B31B 1/06; B31B 1/04; B31B 1/02; B31B 1/26; B31B 3/00; B31B 3/02; B31B 3/26; B31B 3/60; B31B 5/00; B31B 5/02; B31B 5/26
USPC ..... 53/473, 466, 456, 563, 564
See application file for complete search history.

(56) References Cited

U.S. PATENT DOCUMENTS 3,383,825 A * 5/1968 Titchenal et al. ..... 53/438
3,507,088 A * 4/1970 Gillespie et al. ..... 53/53
3,511,014 A * 5/1970 Kochalski ..... 53/436
(Continued)

FOREIGN PATENT DOCUMENTS

JP 2000-168728 6/2000
JP 2003-212202 7/2003
(Continued)

OTHER PUBLICATIONS

Office Action dated Apr. 23, 2012 issued in corresponding Korean Application No. 10-2010-0097063.
(Continued)

*Primary Examiner* — Gloria R Weeks
(74) *Attorney, Agent, or Firm* — Harness, Dickey & Pierce, P.L.C.

(57) ABSTRACT

According to example embodiments, an automatic packing apparatus includes at least one box supply unit configured to move a box stack upwards such that a product is inserted into a packing box of the box stack, the packing box being the uppermost box of the box stack, an inlet formation unit configured to lift the upper surface of the packing box to form an inlet on at least one unbonded side surface of the packing box, a product supply unit configured to transfer the product to the inlet; and a side surface bonding unit configured to bond the at least one unbonded side surface of the packing box. The at least one unbonded side surface includes the inlet and the packing box includes the product inserted therein.

21 Claims, 15 Drawing Sheets

(51) Int. Cl.
*B65B 43/26* (2006.01)
*B65B 43/28* (2006.01)

(56) References Cited

U.S. PATENT DOCUMENTS

| | | | | | |
|---|---|---|---|---|---|
| 3,585,776 | A | * | 6/1971 | Euwe | 53/447 |
| 3,866,391 | A | * | 2/1975 | Puskarz et al. | 53/537 |
| 3,879,922 | A | * | 4/1975 | Derderian | 53/376.5 |
| 3,941,037 | A | * | 3/1976 | Reichert | 493/167 |
| 3,986,319 | A | * | 10/1976 | Puskarz et al. | 53/447 |
| 3,990,210 | A | * | 11/1976 | McDonough et al. | 53/456 |
| 4,030,620 | A | * | 6/1977 | Euverard et al. | 53/473 |
| 4,424,658 | A | * | 1/1984 | Focke | 53/398 |
| 4,524,564 | A | * | 6/1985 | Groom et al. | 53/449 |
| 4,569,182 | A | * | 2/1986 | Leuvering | 53/456 |
| 4,631,900 | A | * | 12/1986 | Mattei et al. | 53/448 |
| 4,909,019 | A | * | 3/1990 | Delacretaz et al. | 53/463 |
| 4,932,930 | A | * | 6/1990 | Coalier et al. | 493/128 |
| 5,154,041 | A | * | 10/1992 | Schneider | 53/456 |
| 5,193,328 | A | * | 3/1993 | Boriani et al. | 53/466 |
| 5,216,870 | A | * | 6/1993 | Boriani et al. | 53/448 |
| 5,404,694 | A | * | 4/1995 | Boriani et al. | 53/466 |
| 5,588,281 | A | * | 12/1996 | Boriani et al. | 53/443 |
| 5,590,763 | A | * | 1/1997 | Focke et al. | 206/271 |
| 5,810,487 | A | * | 9/1998 | Kano et al. | 400/83 |
| 6,145,281 | A | * | 11/2000 | Hansen et al. | 53/447 |
| 6,164,040 | A | * | 12/2000 | Bowman et al. | 53/411 |
| 6,223,500 | B1 | * | 5/2001 | Kramps | 53/399 |
| 6,591,587 | B2 | * | 7/2003 | Salm et al. | 53/461 |
| 7,475,525 | B2 | * | 1/2009 | Focke et al. | 53/447 |
| 8,323,165 | B2 | * | 12/2012 | Atoui | 493/175 |
| 8,453,417 | B2 | * | 6/2013 | Oshio et al. | 53/53 |
| 8,671,654 | B2 | * | 3/2014 | Langen | 53/456 |
| 2001/0039785 | A1 | * | 11/2001 | Greenwell et al. | 53/429 |
| 2006/0207222 | A1 | * | 9/2006 | Long et al. | 53/429 |
| 2010/0263333 | A1 | * | 10/2010 | Langen | 53/456 |

FOREIGN PATENT DOCUMENTS

| | | | |
|---|---|---|---|
| JP | 2003-300510 | A | 10/2003 |
| KR | 2002-0094880 | A | 12/2002 |

OTHER PUBLICATIONS

China Patent Office Communication dated Mar. 2, 2015, "Notification of Granting of Patent Right to Invention," on Application No. 201110306694.8 (with English translation).

* cited by examiner

AUTOMATIC PACKING APPARATUS AND AUTOMATIC PACKING METHOD USING THE SAME

CROSS-REFERENCE TO RELATED APPLICATION

This application claims the priority under 35 U.S.C. §119 to Korean Patent Application No. 2010-0097063, filed on Oct. 5, 2010 in the Korean Intellectual Property Office (KIPO), the entire contents of which is incorporated herein by reference.

BACKGROUND

1. Field

Example embodiments relate to an automatic packing apparatus which automatically packs products in boxes and an automatic packing method using the same.

2. Description

In general, after various products are manufactured, the products are packed in boxes in order to prevent the products from being damaged and to ship/handle the products.

The packing boxes are made of a material, such as thick corrugated cardboard, so as to protect the products from external impact. The manufactured packing boxes are stored in an unassembled state in which the boxes are unfolded in a flat shape so as to reduce a space occupied thereby before being used to pack the products. Then, when the packing boxes are used to pack the products, the packing boxes are assembled (folded) to pack the products.

A worker folds a packing box into an original shape, and then covers a product with the packing box, thereby packing the product in the packing box. Here, the product is covered with the box downwardly from above. Packing of a large-sized home appliance product, such as a refrigerator, a TV or an air conditioner, in such a box requires at least two workers.

As described above, workers manually pack products in boxes and thus packing requires considerable manpower, and a large amount of time is consumed packing each product and thus productivity is reduced.

SUMMARY

According to example embodiments, an automatic packing apparatus configured to automatically pack products in vertically stacked boxes including an upper surface and a lower surface and wherein at least one side surface of each box is not bonded, includes at least one box supply unit configured to move the box stack upwards such that a product is inserted into a packing box of the box stack, the packing box being the uppermost box of the box stack; an inlet formation unit configured to lift the upper surface of the packing box to form an inlet on at least one unbonded side surface of the packing box; a product supply unit configured to transfer the product to the inlet; and a side surface bonding unit configured to bond the at least one unbonded side surface of the packing box. The at least one unbonded side surface includes the inlet and the packing box includes the product inserted therein.

According to example embodiments, the at least one box supply unit includes a bogie on which the box stack is placed, and a lift to raise the bogie in stages.

According to example embodiments, the inlet formation unit includes members configured to be detachably attached to the upper surface of the packing box, and a drive device to vertically move the members.

According to example embodiments, the inlet formation unit further includes a rotating device configured to rotate the members.

According to example embodiments, the automatic packing apparatus, further including an upper and lower box separation unit inserted into a gap between the packing box and a box located under the packing box when the upper surface of the packing box is lifted up, the upper and lower box separation unit configured to separate the box located under the packing box and prevent the box located under the packing box from being transferred together with the packing box.

According to example embodiments, the product supply unit further includes a conveyance unit configured to convey the product to the inlet.

According to example embodiments, the automatic packing apparatus further includes a box transfer unit configured to insert the product into the packing box and to transfer the packing box provided with the product therein.

According to example embodiments, the side surface bonding unit includes a first folding unit configured to fold a first side surface part connected with the upper surface of the packing box, and a second folding unit configured to fold a second side surface part connected with the lower surface of the packing box, the at least one unbonded side surface including the first side surface part and the second side surface part.

According to example embodiments, the first folding unit includes a first folding member pressing the first side surface part to fold the first side surface part, and a drive device to move the first folding member in the upward and downward directions.

According to example embodiments, the side surface bonding unit further includes a pressing unit configured to move in the upward and downward directions to press the upper surface of the packing box.

According to example embodiments, the side surface bonding unit further includes adhesive spray units configured to spray an adhesive to at least one of the first side surface part and the second side surface part.

According to example embodiments, each of the adhesive spray units includes a spray nozzle configured to spray the adhesive, and a movement member connected with the spray nozzle to move the spray nozzle in the leftward and rightward directions.

According to example embodiments, the automatic packing apparatus further includes a box stop unit configured to move in the upward and downward directions to support the rear surface of the packing box, the box stop unit configured to set a stop position of the packing box.

According to example embodiments, the automatic packing apparatus further includes box alignment units to respectively align both side surfaces of the packing box facing each other, the alignment units configured to align both the side surfaces during bonding the at least one unbonded side surface of the packing box.

According to example embodiments, an automatic packing method includes preparing a vertical stack of boxes, each box including upper and lower surfaces and at least one unbonded side surface; moving the box stack upwards to insert a product into a packing box, the packing box being the uppermost box of the box stack; forming an inlet, through which the product is inserted into the packing box, on at least one unbonded side surface of the packing box by lifting up the upper surface of the packing box; transferring the product to the inlet; and bonding the at least one unbonded side surface of the packing box including the inlet.

According to example embodiments, the automatic packing method, further includes placing the box stack on a bogie and moving the box stack in an upward direction by raising the bogie using a lift.

According to example embodiments, the automatic packing method, further includes forming the inlet by lifting up the upper surface of the packing box using members detachably attached to the upper surface of the packing box.

According to example embodiments, the automatic packing method, further includes conveying the product into the inlet by a conveyer belt.

According to example embodiments, the automatic packing apparatus, further includes providing the at least one unbonded side surface of the packing box including a first side surface part connected with the upper surface of the packing box and a second side surface part connected with the lower surface of the packing box; spraying an adhesive on at least one of the first side surface part and the second side surface; and bonding the first side surface part and the second side surface part using the adhesive by folding the first side surface part downwards and folding the second side surface parts upwards.

According to example embodiments, the automatic packing method, further includes transferring the packing box including the product therein out of the box stack before the at least one unbonded side surface of the packing box is bonded.

According to example embodiments, an automatic packing apparatus configured to automatically pack products in vertically stacked boxes including upper and lower surfaces and wherein at least one side surface of each box is not bonded, includes a frame forming a space in which a product is packed; at least one box supply unit configured to supply the box stack to the frame and configured to move the box stack upwards so that the product is inserted into a packing box, the packing box being the uppermost box of the box stack; an inlet formation unit fixed to the frame, the inlet formation unit configured to lift the upper surface of the packing box to form an inlet through which the product is inserted into the packing box, the inlet being on at least one unbonded side surface of the packing box; a product supply unit configured to transfer the product to the inlet; and a side surface bonding unit fixed to the frame and configured to bond the at least one unbonded side surface of the packing box. The at least one unbonded side surface of the packing box includes the inlet and the packing box includes the product inserted therein.

BRIEF DESCRIPTION OF THE DRAWINGS

The above and other features and advantages will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

Figure 1:
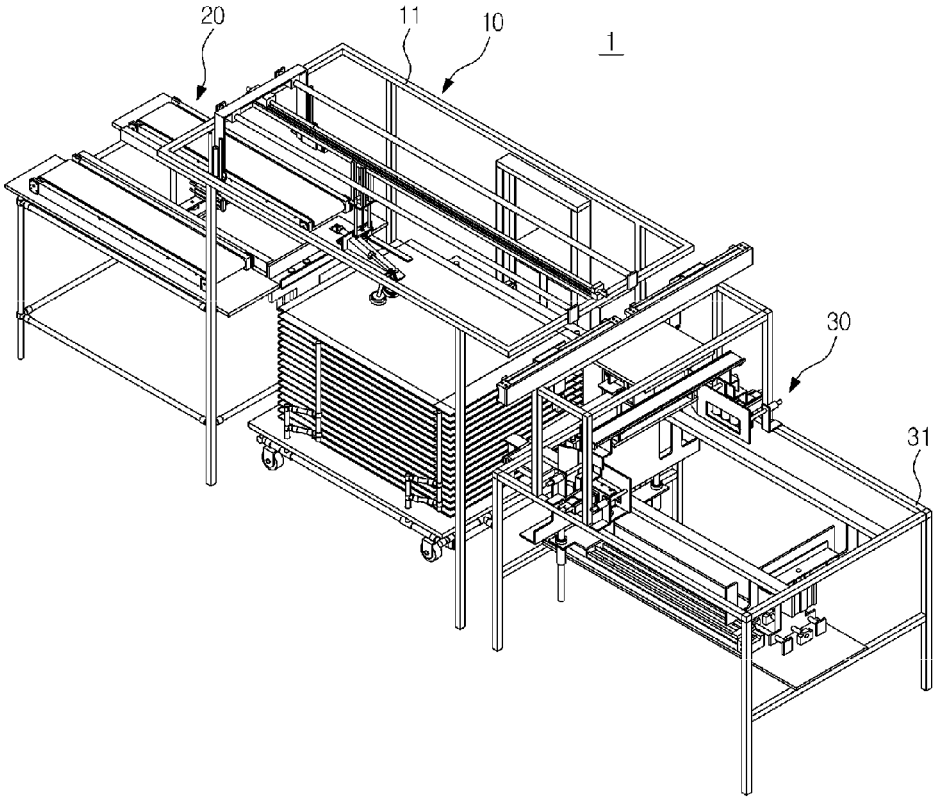
FIG. 1 is a perspective view of an automatic packing apparatus in accordance with example embodiments.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION

Example embodiments will now be described more fully with reference to the accompanying drawings, in which example embodiments are shown. Example embodiments may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 2:
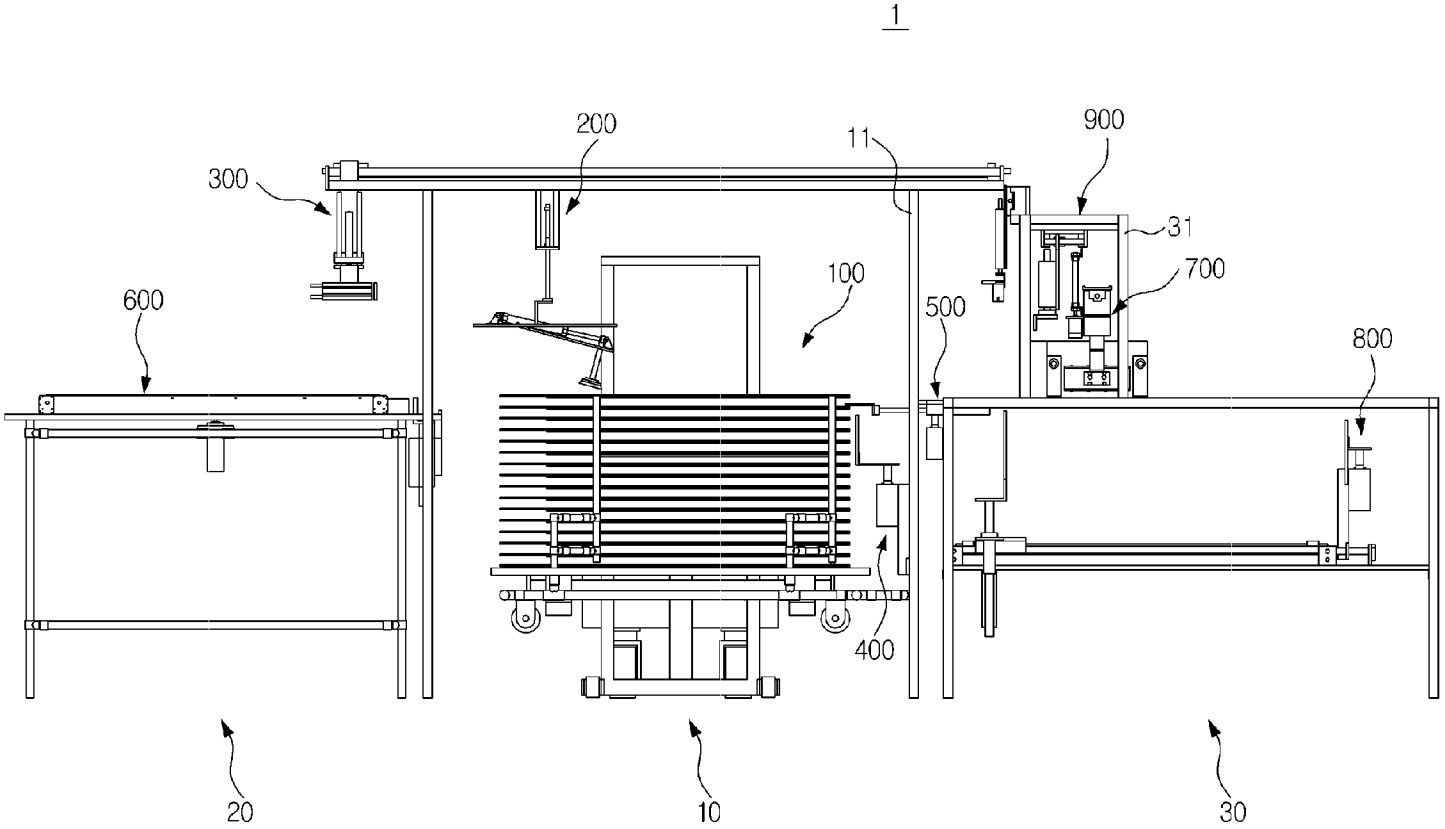
FIG. 2 is a side view of the automatic packing apparatus in accordance with example embodiments.

FIG. 1 is a perspective view of an automatic packing apparatus in accordance with example embodiments and FIG. 2 is a side view of the automatic packing apparatus in accordance with example embodiments.

As shown in FIG. 1, an automatic packing apparatus 1 includes a product insertion part 10 through which a product is inserted into a box, a product supply part 20 to supply the product to the product insertion part 10, and a side surface bonding part 30 to bond side surface parts of the box into which the product is inserted. A direction in which the product supply part 20 is located with respect to the product insertion part 10 is defined as a forward direction.

The product insertion part 10 includes an insertion part frame 11, box supply units 100 to supply boxes used to pack products to the inside of the insertion part frame 11, and an inlet formation unit 200 to form an inlet, through which a product is inserted into a box, on the box. The product insertion part 10 may further include a box transfer unit 300 to transfer the box provided with the product therein to the outside and a first box stop unit 400 to stop backward movement of the box so as to insert the product into the box.

The product supply part 20 includes a product supply unit 600 to supply the product to the product insertion part 10. The product is placed on the product supply unit 600.

The side surface bonding part 30 bonds side surface parts of the box transferred from the product insertion part 10 under the condition that a side surface of the box into which the product is inserted is opened. The side surface bonding part 30 includes a bonding part frame 31, box alignment units 700 to align the box transferred from the product insertion part 10, a second box stop unit 800 to set a stop position of the transferred box and to stop transfer of the box, and a side surface bonding unit 900 to bond the side surface parts of the box. An upper and lower box separation unit 500 may be mounted on the bonding part frame 31. Alternatively, the upper and lower box separation unit 500 may be mounted on the insertion part frame 11. The insertion part frame 11 and the bonding part frame 31 may be formed integrally. Further, the product supply part 20 may be disposed within the insertion part frame 11.

The product is inserted into the box within the insertion part frame 11. The product is supplied to the inside of the insertion part frame 11 by the product supply unit 600 and is inserted into the box supplied by the box supply unit 100. Then, the box with the product therein is transferred out of the insertion part frame 11 by the box transfer unit 300. The front surface and the rear surface of the insertion part frame 11 are opened so that the product may enter the insertion part frame 11 through the opened front surface thereof and exit the insertion part frame 11 through the opened rear surface thereof. The product supply part 20 is disposed in front of the product insertion part 10 and the side surface bonding part 30 is disposed at the rear of the product insertion part 10.

The box supply unit 100 supplies boxes used to pack products and moves each box to a position at which a product is inserted into the box. The box supply unit 100 is configured such that the box supply unit 100 is movable to the outside of the insertion part frame 11 when all of the boxes in the box supply unit 100 have been used. Therefore, at least one surface of the insertion part frame 11 may be opened such that the box supply unit 100 enters and exits the insertion part frame 11 through the at least one opened surface thereof. The box supply unit 100 moves to the inside of the insertion part frame 11 through one side surface of the insertion part frame 11 so as to supply boxes, and the side surface of the insertion part frame 11 is opened such that the box supply unit 100 enters and exits the insertion part frame 11 through the opened side surface thereof. In example embodiments, both left and right side surfaces of the insertion frame 11 are opened such that at least two box supply units 100 may be alternately used to supply boxes.

Figure 3:
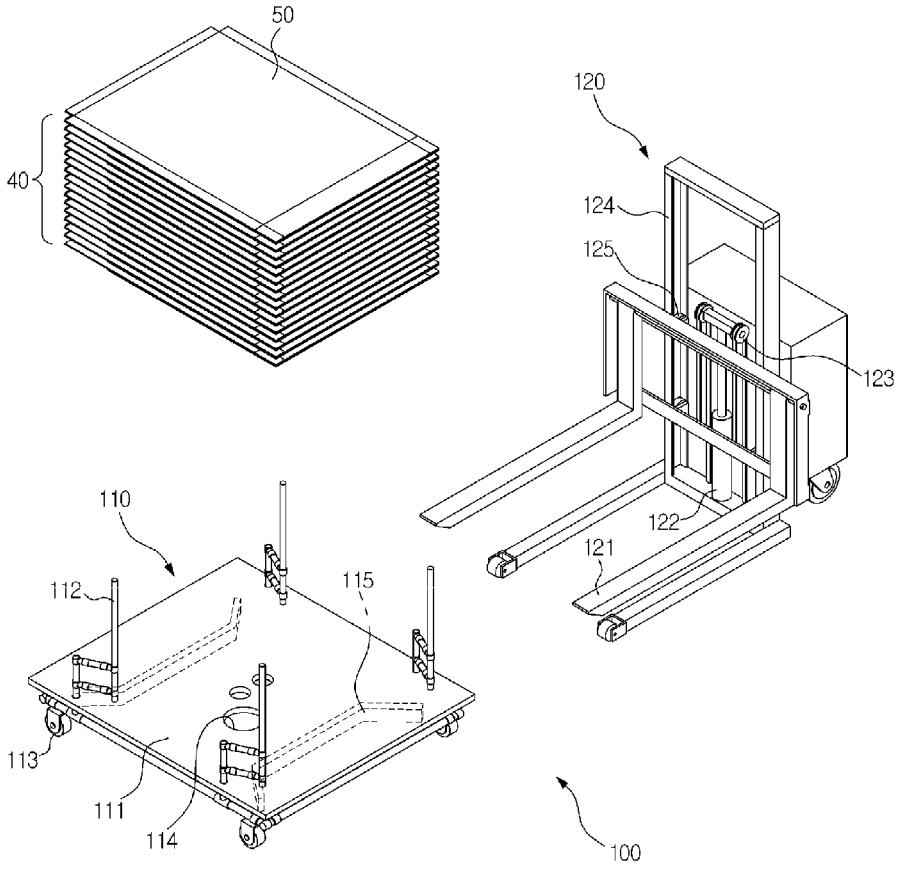
FIG. 3 is a view illustrating a box supply unit of the automatic packing apparatus in accordance example embodiments.

FIG. 3 is a view illustrating the box supply unit of the automatic packing apparatus in accordance with example embodiments.

As shown in FIG. 3, the box supply unit 100 includes a bogie 110 on which a box stack 40 is seated, and a lift 120 to raise the bogie 110 in stages.

Each of the boxes constituting the box stack 40 is in a state in which upper and lower surfaces of the box are piled and at least one side surface of the box is not closed. The boxes are stacked such that unbonded side surfaces of the boxes face the product supply part 20 shown in FIG. 1, thereby forming the box stack 40. The box located at the uppermost position of the box stack 40 such that a product is inserted into the box is defined as a packing box 50.

The box stack 40 is seated on the bogie 110. The bogie 110 includes a support plate 111 to support the box stack 40, a plurality of alignment guides 112 to set a seated position of the box stack 40, and a plurality of wheels 113 installed on the lower surface of the support plate 111 such that the bogie 110 is movable. A handle (not shown) is detachably mounted on the bogie 110. A vacuum prevention hole 114 is formed through the support plate 111 at a position where the box stack 40 is seated so as to allow the lowermost box of the box stack 40 to be easily removed from the support plate 111. Further, guide protrusions 115 to set connection positions with the lift 120, which will be described below, are provided on the lower surface of the support plate 111.

The lift 120 is connected to the bogie 110 on which the box stack 40 is placed. The lift 120 includes lift arms 121 to support the bogie 110, a drive device 122 to ascend or descend the lift arms 121, a power transmission device 123 to connect the lift arms 121 and the drive device 122, and guides 124 to guide movement of the lift arms 121. Guide rollers 125 are mounted at connection portions between the lift arms 121 and the guides 124. The drive device 122 may be a hydraulic cylinder. The power transmission device 123 may include a chain and sprockets. The guide protrusions 115 of the support plate 111 are provided corresponding to the connection positions with the lift arms 121.

The lift 120 ascends the bogie 110 in stages so as to move the packing box 50 to a position where a product is inserted into the packing box 50. The height by which the bogie 110 is moved in each stage corresponds to the height of each of boxes constituting the box stack 40. A speed adjustment device (not shown) to adjust an ascending speed of the lift arms 121 is mounted on the drive device 122. If the drive device 122 is a hydraulic cylinder, the speed adjustment device (not shown) may be a hydraulic adjustment valve mounted on the hydraulic cylinder.

When the product is inserted into the packing box 50 and then the packing box 50 provided with the product therein is transferred to the side surface bonding part 30 shown in FIG. 1, the lift 120 again ascends by the designated height. Therefore, the box located at the uppermost position of the box stack 40 reaches the position where a product is inserted into the box. Such a process is repeated until all of the boxes constituting the box stack 40 have been used.

Figure 4:
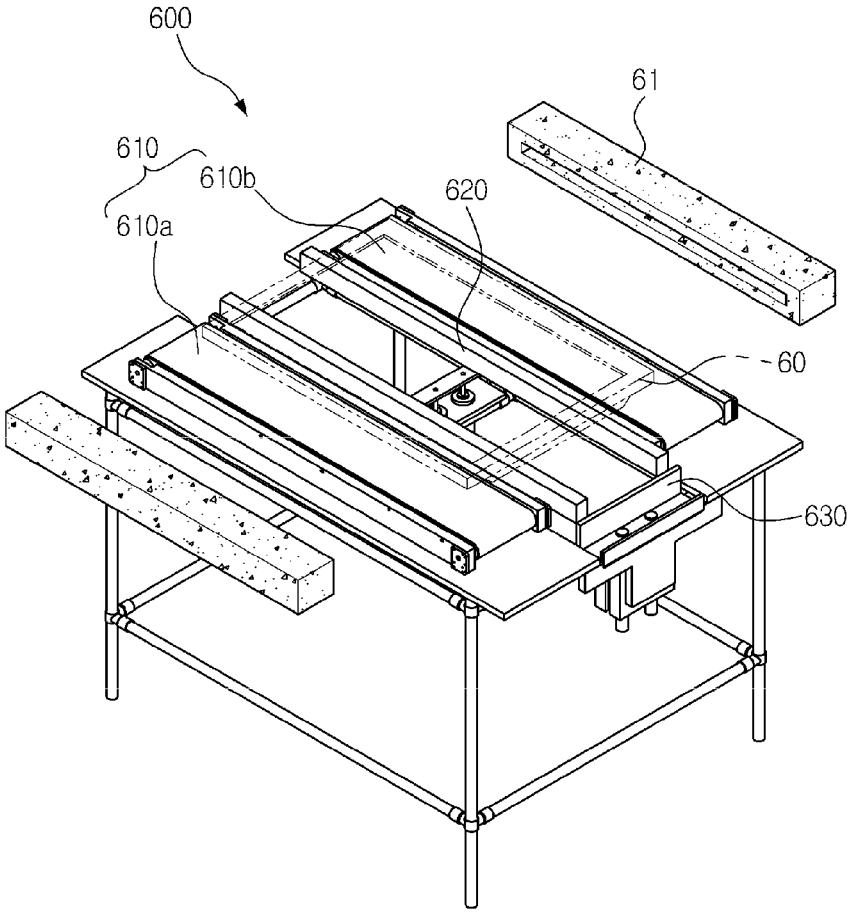
FIG. 4 is a view illustrating a product supply unit of the automatic packing apparatus in accordance example embodiments.

FIG. 4 is a view illustrating the product supply unit of the automatic packing apparatus in accordance with example embodiments.

As shown in FIG. 4, the product supply unit 600 includes a conveyance unit 610 to move a product 60 to the product insertion part 10 shown in FIG. 1, a separation unit 620 to separate the product 60 from the conveyance unit 610, and a product stop unit 630 provided around one end of the conveyance unit 610 to prevent the product 60 from falling. The conveyance unit 610 may include a conveyer belt.

The conveyance unit 610 includes a first conveyance device 610*a* and a second conveyance device 610*b* separated from each other by a designated interval. The separation unit 620 is disposed between the first conveyance device 610*a* and the second conveyance device 610*b*.

Buffer members 61 are mounted at edges of the product 60 so as to separate the product 60 from the inner surface of the box and to protect the product 60 from external impact applied to the box. The separation unit 620 supports the lower surface of the product 60 so as to separate the product 60 from the surface of the product supply unit 600, thereby forming a space where the buffer members 61 are mounted at the edges of the product 60.

The product stop unit 630 is movable in the upward and downward directions. The product stop unit 630 is driven by a motor. The product stop unit 630 maintains the upward moved state until the product 60 is conveyed to the product insertion part 10 shown in FIG. 1, thereby preventing the product 60 from falling at the rear portion of the product supply unit 20. When the conveyance unit 610 is driven to convey the product 60 to the product insertion part 10 shown in FIG. 1, the product stop unit 630 is moved downwards.

Figure 5:
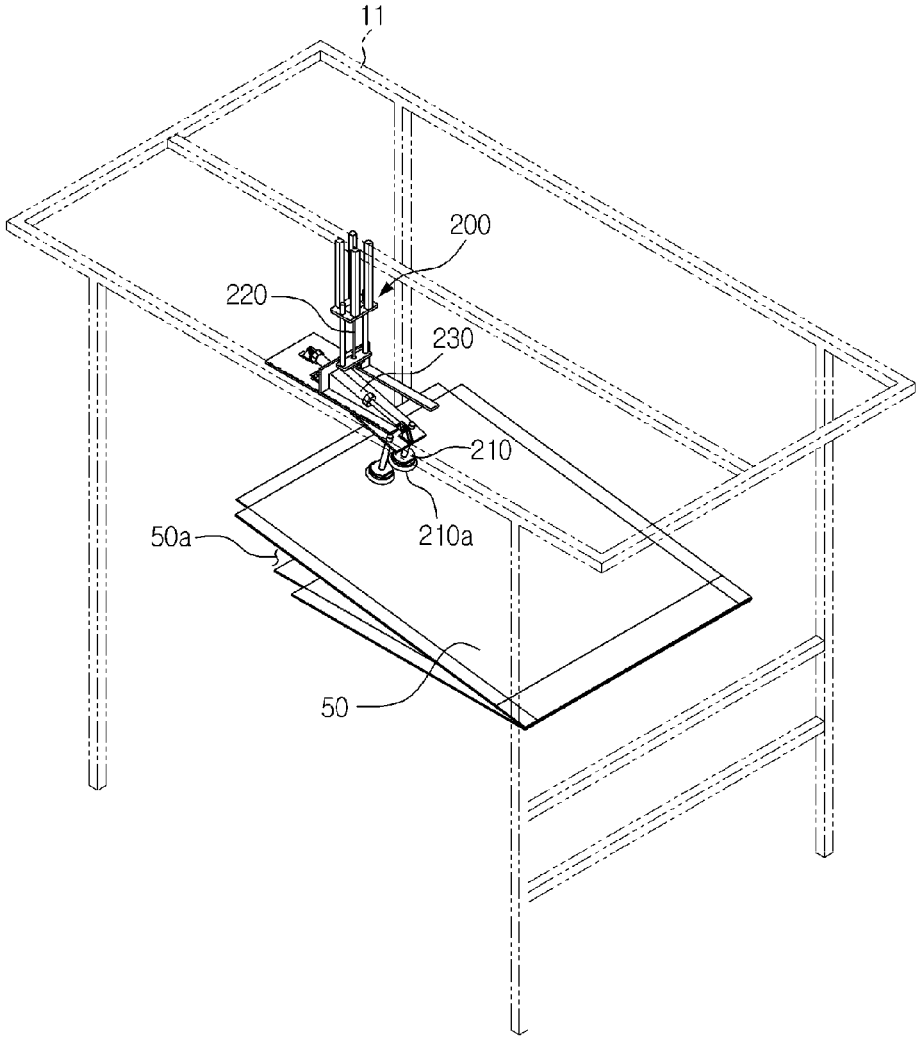
FIG. 5 is a view illustrating an inlet formation unit of the automatic packing apparatus in accordance with example embodiments.

FIG. 5 is a view illustrating the inlet formation unit of the automatic packing apparatus in accordance with example embodiments.

As shown in FIG. 5, the inlet formation unit 200 is fixed to the upper portion of the insertion part frame 11. The inlet formation unit 200 includes members 210 which are detachably attached to the upper surface of the packing box 50, a drive device 220 to move the members 210 in the upward and downward directions, and a rotating device 230 to rotate the members 210 downwards.

The members 210 move downwards and are attached to the upper surface of the packing box 50. The members 210 may include vacuum pads 210*a*. The vacuum pads 210*a* are connected to a vacuum generator (not shown).

The drive device 220 moves the members 210 downwards so as to attach the members 210 to the upper surface of the packing box 50. When the members 210 are attached to the upper surface of the packing box 50, the drive device 220 moves the members 210 upwards. Since the lower surface of the packing box 50 is supported by another box located thereunder or the support plate 111 shown in FIG. 3, an inlet 50*a* is formed between the upper surface and the lower surface of the packing box 50. The product is inserted into the packing box 50 through the inlet 50*a*. The drive device 220 may include a hydraulic cylinder.

When the upper surface of the packing box 50 moves upwards by means of the drive device 220 together with the members 210, the lower surface of the packing box 50 has an inclination with respect to the box located thereunder or the support plate 111 shown in FIG. 3. Therefore, in order to eliminate the inclination, the rotating device 230 rotates the members 210 attached to the upper surface of the packing box 50 downwards. The rotating device 230 may include a hinge and a hydraulic cylinder.

Figure 6:
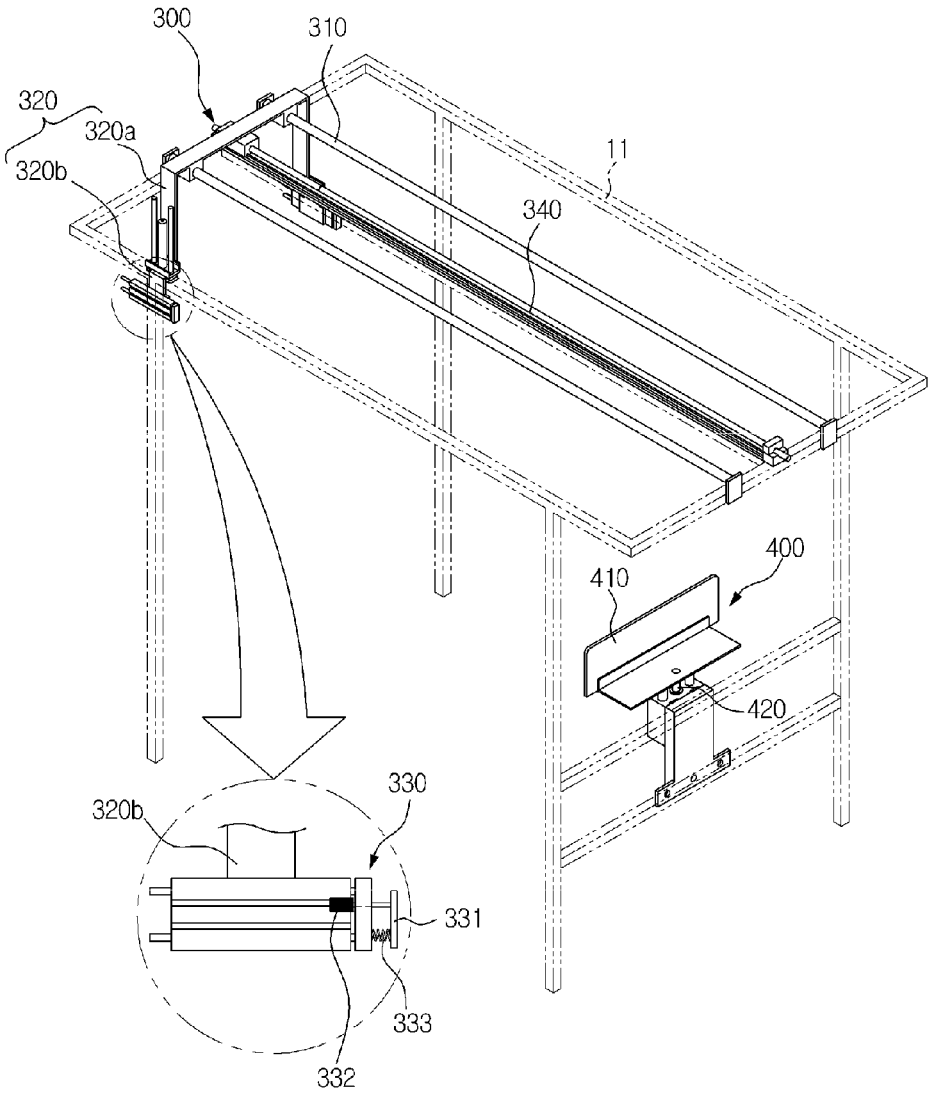
FIG. 6 is a view illustrating a box transfer unit and a first box stop unit of the automatic packing apparatus in accordance with example embodiments.

FIG. 6 is a view illustrating the box transfer unit and the first box stop unit of the automatic packing apparatus in accordance with example embodiments.

As shown in FIG. 6, the box transfer unit 300 is fixed to the upper portion of the insertion part frame 11 and is movable in the forward and backward directions of the insertion part frame 11. The box transfer unit 300 includes transfer guides 310 extended in the forward and backward directions of the insertion part frame 11 and fixed to the upper portion of the insertion part frame 11, transfer members 320 moving along the transfer guides 310, a drive device 340 to drive the transfer members 320, and sensing devices 330 to sense stoppage of the transferred product so as to stop operation of the drive device 340.

Both ends of the transfer guides 310 are fixed to the upper portion of the insertion part frame 11. A plurality of transfer guides 310 is provided to guide the transfer members 320 while stably supporting the transfer members 320.

The transfer members 320 are connected to the transfer guides 310 so as to move along the transfer guides 310 and are extended downwards. The transfer members 320 include a first transfer member 320*a* connected to the transfer guides 310, and second transfer members 320*b* connected to the first transfer member 320*a* and pushing the side surfaces of the product. The second transfer members 320*b* are movable in the upward and downward directions of the first transfer member 320*a*.

The drive device 340 is connected to the transfer members 320 and moves the transfer members 320 along the transfer guides 310. The drive device 340 may include a rodless cylinder, both ends of which are fixed to the upper portion of the insertion part frame 11.

The sensing devices 330 are mounted on the second transfer members 320*b*. The sensing devices 330 sense stoppage of the product when the product is stopped such that the product is completely inserted into the packing box. Each of the sensing devices 330 includes a contact part 331 contacting the side surface of the product, a dog sensor 332 and an elastic body 333 to support the contact part 331.

The first box stop unit 400 is fixed to the rear portion of the insertion part frame 11. The first box stop unit 400 includes a first stop plate 410 movable in the upward and downward directions and a drive device 420 to move the first stop plate 410. The drive device 420 may include a hydraulic cylinder.

When the box transfer unit 300 pushes the side surfaces of the product to insert the product into the packing box, the first stop plate 410 moves upwards so as to support the rear surface of the packing box. When the product is inserted into the packing box and then movement of the product is stopped by the first stop plate 410, the sensing devices 330 sense stoppage of the product and then driving of the drive device 420 is stopped. Then, the first stop plate 410 moves downwards before the packing box is transferred to the side surface bonding part 30 shown in FIG. 1.

Figure 7:
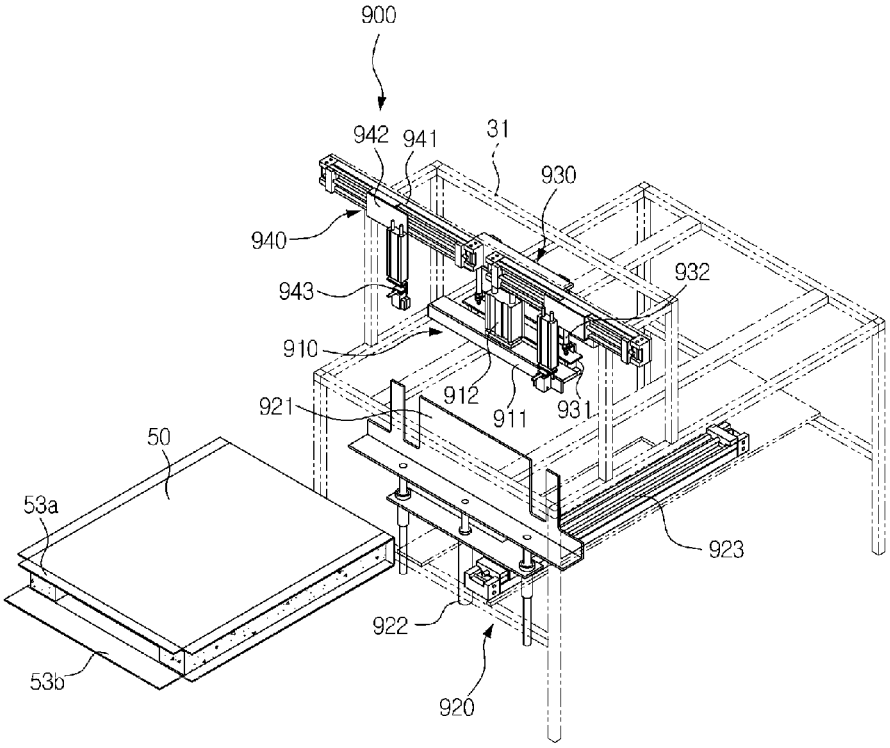
FIG. 7 is a view illustrating a side surface bonding unit of the automatic packing apparatus in accordance with example embodiments.

FIG. 7 is a view illustrating the side surface bonding unit of the automatic packing apparatus in accordance with example embodiments.

As shown in FIG. 7, the side surface of the packing box 50 is formed by a first side surface part 53*a* connected to the upper surface of the packing box 50 and a second side surface part 53*b* connected to the lower surface of the packing box 50. The side surface bonding unit 900 includes a first folding unit 910 fixed to the bonding part frame 31 so as to be located above the packing box 50, a second folding unit 920 fixed to the bonding part frame 31 so as to be located below the packing box 50, a pressing unit 930 fixed to the bonding part frame 31 so as to be located above the packing box 50 and serving to press the upper surface of the packing box 50, and adhesive spray units 940 to spray an adhesive to at least one of the first side surface part 53*a* and the second side surface part 53*b*.

The first folding unit 910 folds the first side surface part 53*a* downwards. The first folding unit 910 includes a first folding member 911 pressing the first side surface part 53*a* to fold the first side surface part 53*a*, and a drive device 912 fixed to the bonding part frame 31 and connected with the first folding member 911 to move the first folding member 911 in the upward and downward directions. The drive device 912 may include a hydraulic cylinder.

The second folding unit 920 folds the second side surface part 53*b* upwards. The second folding unit 920 includes a second folding member 921 pressing the second side surface part 53*b* to fold the second side surface part 53*b*, and a drive device 922 fixed to the bonding part frame 31 and connected with the second folding member 921 to move the second folding member 912 in the upward and downward directions. The drive device 922 may include a hydraulic cylinder.

The second folding unit 920 further includes a transfer device 923 to move the second folding member 921 in the forward and backward directions. The second folding unit 920 pushes the second side surface part 53*b* backwards to bond the second side surface part 53*b* to the first side surface part 53*a*, and transfers the packing box 50 to the rear portion of the side surface bonding part 30 shown in FIG. 1.

The pressing unit 930 includes a pressing member 931 pressing the upper surface of the packing box 50, and driving devices 932 fixed to the bonding part frame 31 and connected with the pressing member 931 to move the pressing member 931 in the upward and downward directions. Two driving devices 932 are provided and located at the left and right sides of the pressing member 931.

Each of the adhesive spray units 940 includes a guide member 941 extended in the leftward and rightward directions on the bonding part frame 31, a movement member 942 movably connected with the guide member 941, and a spray member 943 connected with the movement member 942 to spray an adhesive. The spray member 943 is connected with the movement member 942 so as to be movable in the upward and downward directions of the movement member 942. The guide member 941 includes a rodless cylinder to move the movement member 942. Here, for instance, two adhesive spray units 940 are provided and fixed to the left and right sides of the bonding part frame 31.

The spray member 943 includes a spray nozzle to spray the adhesive downwards, and a hose (not shown) to supply the adhesive is connected to the spray member 943. The adhesive is made of a hot melt material.

A reflection type optical sensor (not shown) may be mounted on the spray member 943. When the spray member 943 is moved together with the movement member 942, the reflection type optical sensor (not shown) senses whether or not the packing box 50 is present under the spray member 943. When a designated time from sensing of the packing box 50 elapses, the spray member 943 starts spraying the adhesive. A position sensor (not shown) is mounted at the end of the guide member 941, and when the position sensor (not shown) senses the movement member 942, spraying of the adhesive is stopped.

Figure 8:
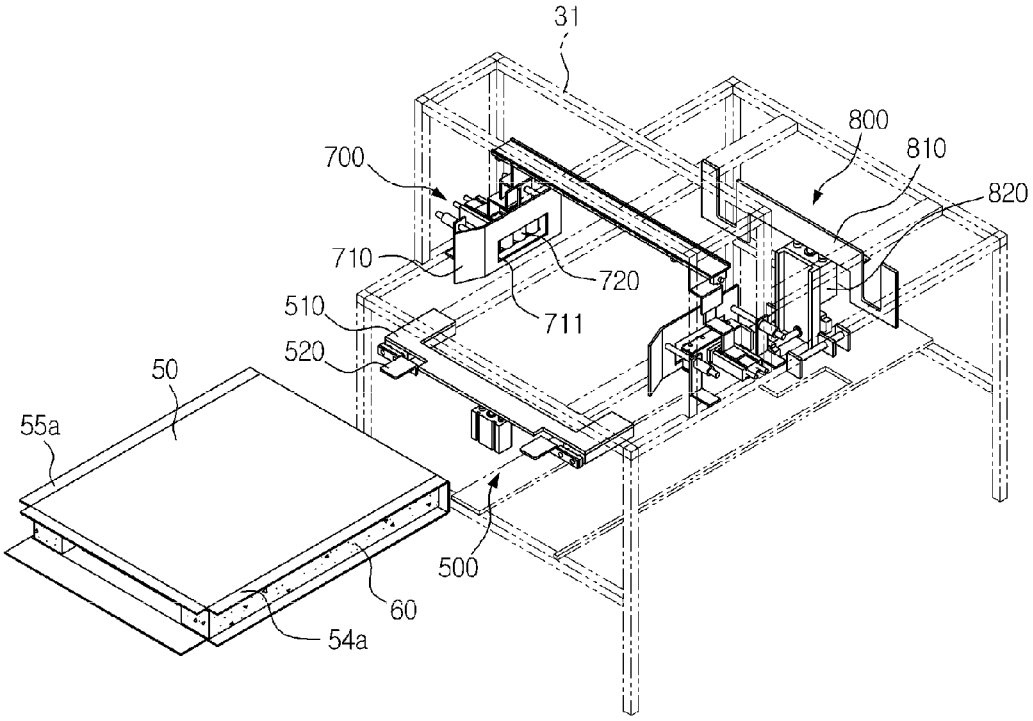
FIG. 8 is a view illustrating box alignment units, an upper and lower box separation unit and a second box stop unit of the automatic packing apparatus in accordance with example embodiments.

FIG. 8 is a view illustrating the box alignment units, the upper and lower box separation unit and the second box stop unit of the automatic packing apparatus in accordance with example embodiments.

As shown in FIG. 8, each of the box alignment units 700 includes a first alignment member 710, and a second alignment member 720 movably connected to the first alignment member 710.

The first alignment members 710 of the box alignment units 700 disposed at the left and right sides of the bonding part frame 31 guide a left wing 54*a* and a right wing 54*b* of the packing box 50 transferred to the bonding part frame 31. The first alignment members 710 of the box alignment units 700 are movable in the leftward and rightward directions such that positions of the first alignment members 710 may be changed according to the width of the packing box 50. An alignment hole 711 through which the second alignment member 720 passes is formed through the first alignment member 710.

The second alignment members 720 of the box alignment units 700 pass through the alignment holes 711, thereby aligning the left and right sides of the product inserted into the packing box 50. For this purpose, the second alignment members 720 of the box alignment units 700 are movable in the leftward and rightward directions so as to contact the product inserted into the packing box 50.

The upper and lower box separation unit 500 includes a support member 510 connected to the bonding part frame 31, and a separation plate 520 connected with the support member 510 so as to be movable in the forward and backward directions. The support member 510 is movable in the upward and downward directions so as to adjust the position of the separation plate 520 in the upward and downward directions.

With reference to FIGS. 5 and 8, when the inlet formation unit 200 lifts up the packing box 50, the box located under the packing box 50 may be adhered to the lower surface of the packing box 50. In order to prevent this, before the inlet formation unit 200 lifts up the packing box 50, the separation plate 520 is moved forwards and is inserted into a gap between the packing box 50 and the box located under the packing box 50. Thereby, movement of the box located under the packing box 50 is restricted by the separation plate 520, and thus the box located under the packing box 50 is separated from the packing box 50.

The second box stop unit 800 includes a second stop plate 810 movable in the upward and downward directions and a drive device 820 to move the second stop plate 810. The drive device 820 may include a hydraulic cylinder.

The second box stop unit 800 sets a stop position of the packing box 50. When the packing box 50 is transferred to the bonding part frame 31, the second stop plate 810 is moved upwards and stops movement of the packing box 50. When movement of the packing box 50 is stopped by the second box stop unit 800, the sensing devices 330 shown in FIG. 6 sense the packing box 50 and operation of the box transfer unit 300 shown in FIG. 6 is stopped.

Figure 9:
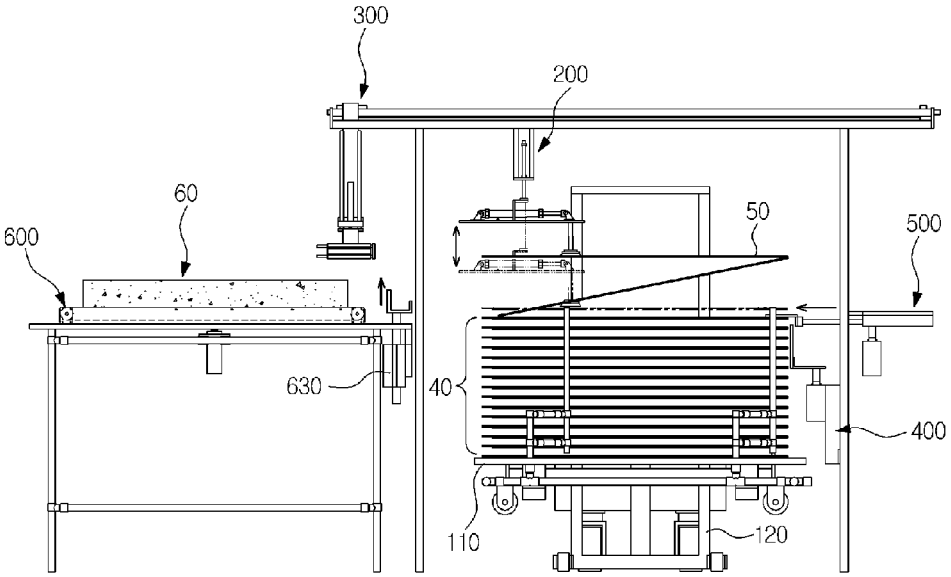
FIGS. 9 to 11 are views illustrating a process of inserting a product into a packing box.
Figure 10:
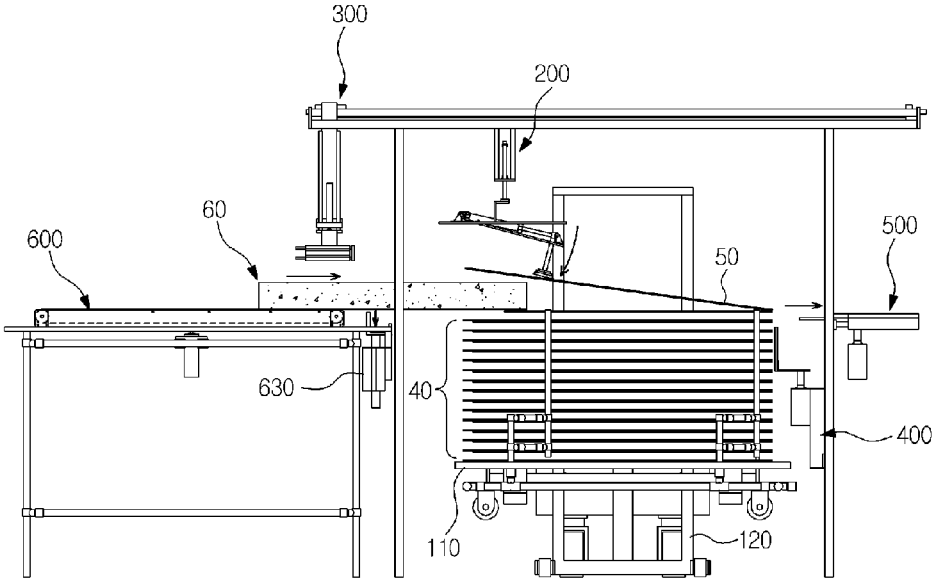
Figure 11:
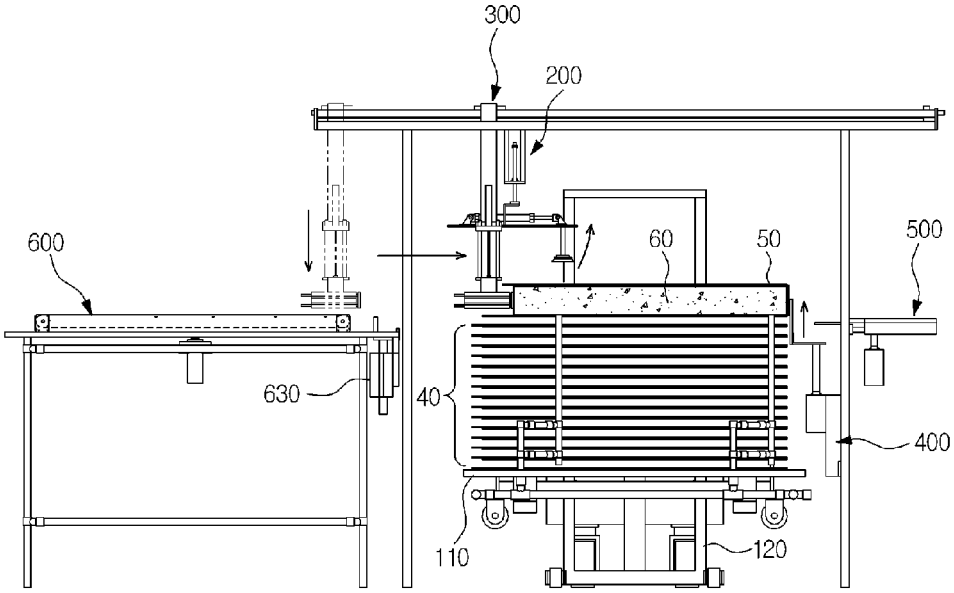

FIGS. 9 to 11 are views illustrating a process of inserting the product into the packing box.

As shown in FIG. 9, the lift 120 ascends the bogie 110 on which the box stack 40 is placed by a designated height so that the packing box 50 is moved to a position where the product 60 is inserted into the packing box 50. Thereafter, the upper and lower box separation unit 500 is inserted into a gap between the packing box 50 and a box located immediately under the packing box 50. The inlet formation unit 200 lifts up the packing box 50. The product stop unit 630 is in a state in which it is moved upwards so as to prevent the product 60 from falling.

As shown in FIG. 10, the inlet formation unit 200 causes the upper surface of the packing box 50 to be inclined such that the lower surface of the packing box 50 is parallel with the box located immediately under the packing box 50. The product stop unit 630 is moved downwards and the product supply unit 600 supplies the product 60 into the packing box 50. Here, the upper and lower box separation unit 500 is in a state in which it is moved backwards.

As shown in FIG. 11, the first box stop unit 400 is moved upwards and supports the rear surface of the packing box 50. The box transfer unit 300 pushes the product 60 so as to be inserted into the packing box 50. Here, the inlet formation unit 200 is in a state in which it is moved upwards. Thereby, the process of inserting the product into the packing box is completed.

FIGS. 12 to 15 are views illustrating a process of bonding the side surface parts of the packing box.

Figure 12:
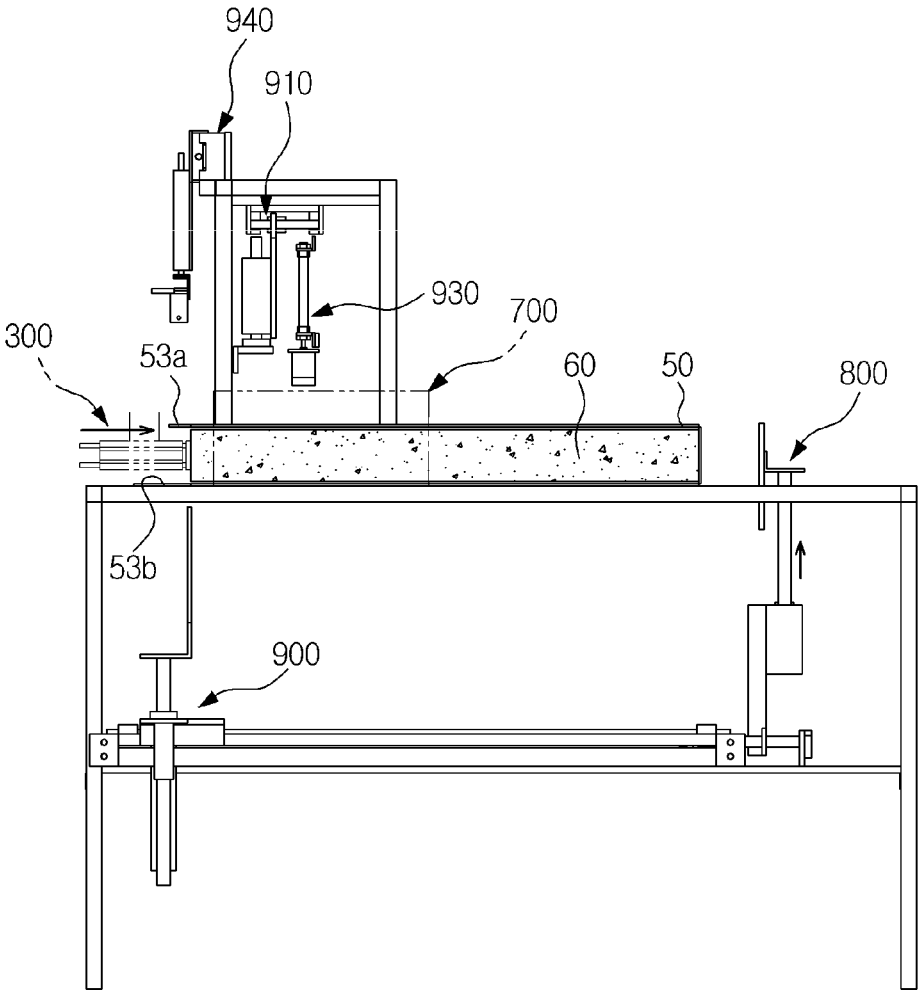
FIGS. 12 to 15 are views illustrating a process of bonding side surface parts of the packing box.

As shown in FIG. 12, the box transfer unit 300 transfers the packing box 50 provided with the product 60 therein. The first folding unit 910, the adhesive spray units 940 and the pressing unit 930 are located above the packing box 50, and the second folding unit 920 is located below the packing box 50. Thereafter, the second box stop unit 800 is moved upwards. The packing box 50 is transferred that the left and right sides of the packing box 50 are aligned by the box alignment units 700.

Figure 13:
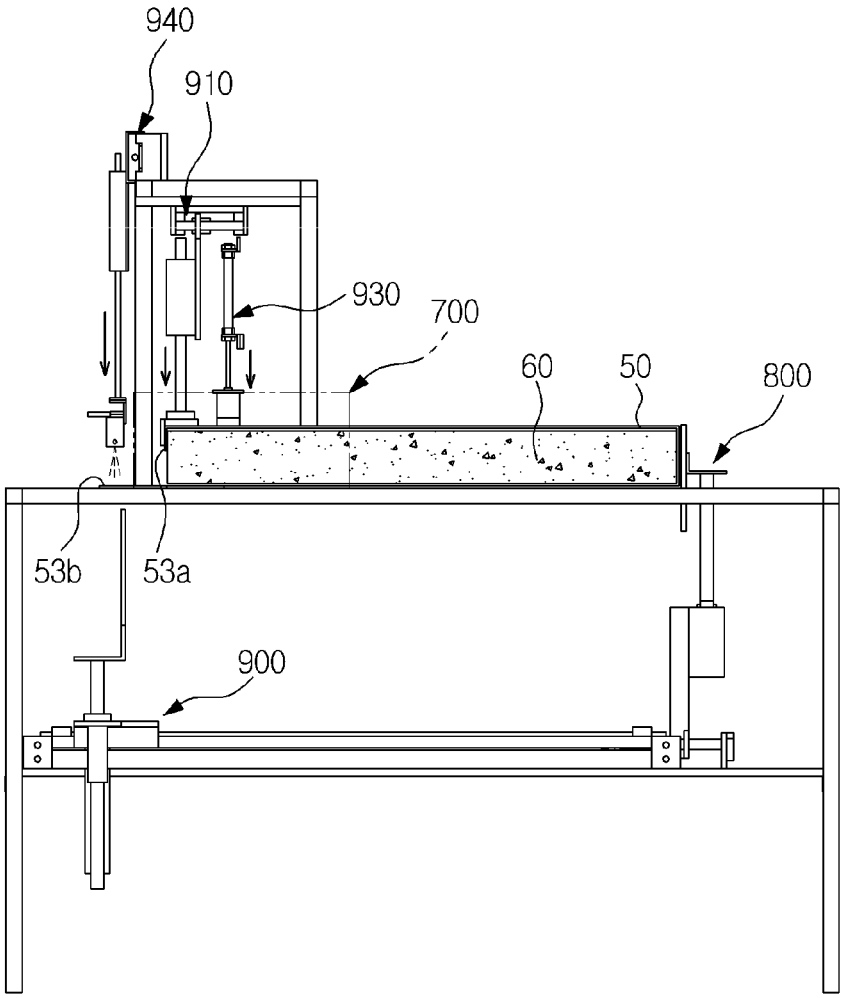

As shown in FIG. 13, when the packing box 50 is stopped by the second box stop unit 800, transfer of the packing box 50 is stopped. Then, the pressing unit 930 presses the upper surface of the packing box 50 and the first folding unit 910 folds the first side surface part 53*a* of the packing box 50. The adhesive spray units 940 are moved downwards and spray an adhesive to the second side surface part 53*b* of the packing box 50.

Figure 14:
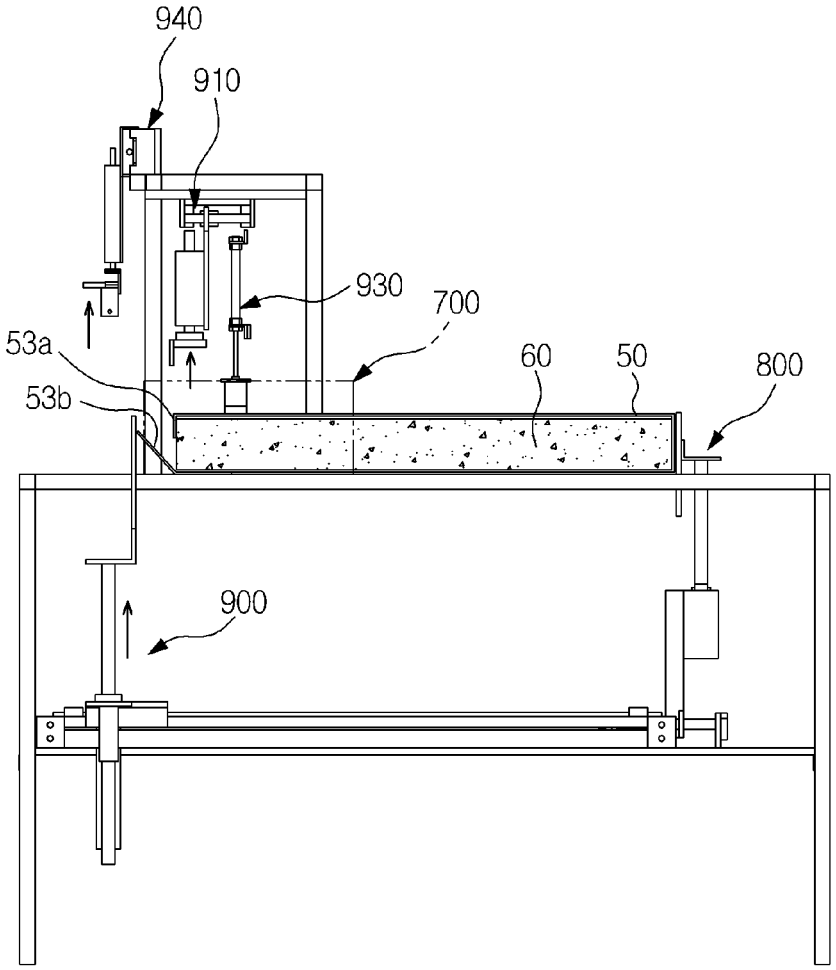

As shown in FIG. 14, the adhesive spray units 940 and the first folding unit 910 are moved upwards. However, the pressing unit 930 maintains pressing of the upper surface of the packing box 50. Thereafter, the second folding unit 920 is moved upwards and folds the second side surface part 53*b*. The second folding unit 920 is moved backwards and pushes the second side surface part 53*b* onto the first side surface part 53*a*, thereby forming the side surface of the packing box 50 through bonding of the first and second side surface parts 53*a* and 53*b*.

Figure 15:
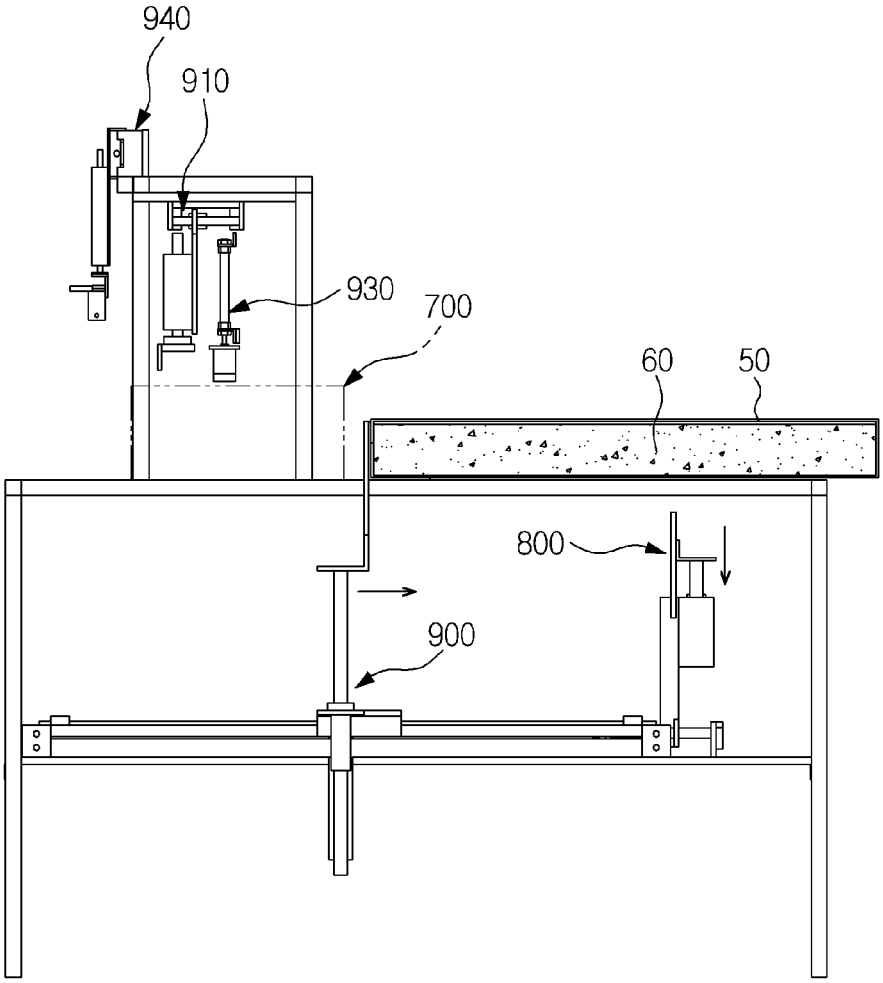

As shown in FIG. 15, the second box stop unit 800 is moved downwards, and the second folding unit 920 pushes the packing box 50 backwards. Thereby, the process of forming the side surface of the packing box 50 through bonding of the first and second side surface parts 53*a* and 53*b* is completed.

Wing folding devices (not shown) may be provided at the rear of the automatic packing apparatus 1. The wing folding devices (not shown) respectively bond the left and right wings of the packing box 50, the side surface of which has been formed, thereby completing packing of the product in the packing box 50.

As is apparent from the above description, an automatic packing apparatus and an automatic packing method using the same in accordance example embodiments automate a series of processes of packing a product in a flat packing box. Therefore, manpower required for packing of the product is reduced and thus labor expenses are reduced, and time taken to pack the product is shortened and thus productivity is improved.

While example embodiments have been particularly shown and described, it will be understood by one of ordinary skill in the art that variations in form and detail may be made therein without departing from the spirit and scope of the claims.

What is claimed is:

1. An automatic packing apparatus configured to automatically pack products in vertically stacked boxes including an upper surface and a lower surface and wherein at least one side surface of each box is not bonded, the apparatus comprising:

at least one box supply unit configured to move the box stack vertically upwards to an upper position such that a product is inserted into a packing box of the box stack, the packing box being the uppermost box of the box stack;

an inlet formation unit configured to lift the upper surface of the packing box at the upper position to form an inlet on at least one unbonded side surface of the packing box;

a product supply unit configured to transfer the product to the inlet at the upper position; and a side surface bonding unit configured to bond the at least one unbonded side surface of the packing box, the at least one unbonded side surface including the inlet and the packing box including the product inserted therein.

2. The automatic packing apparatus according to claim 1, wherein the at least one box supply unit includes a bogie on which the box stack is placed, and a lift to raise the bogie in stages.

3. The automatic packing apparatus according to claim 1, wherein the inlet formation unit includes members configured to be detachably attached to the upper surface of the packing box, and a drive device to vertically move the members.

4. The automatic packing apparatus according to claim 3, wherein the inlet formation unit further includes a rotating device configured to rotate the members.

5. The automatic packing apparatus according to claim 1, further comprising:

an upper and lower box separation unit inserted into a gap between the packing box and a box located under the packing box when the upper surface of the packing box is lifted up, the upper and lower box separation unit configured to separate the box located under the packing box and prevent the box located under the packing box from being transferred together with the packing box.

6. The automatic packing apparatus according to claim 1, wherein the product supply unit further includes a conveyance unit configured to convey the product to the inlet.

7. The automatic packing apparatus according to claim 1, further comprising a box transfer unit configured to insert the product into the packing box and to transfer the packing box provided with the product therein.

8. The automatic packing apparatus according to claim 1, wherein the side surface bonding unit includes a first folding unit configured to fold a first side surface part connected with the upper surface of the packing box, and a second folding unit configured to fold a second side surface part connected with the lower surface of the packing box, the at least one unbonded side surface including the first side surface part and the second side surface part.

9. The automatic packing apparatus according to claim 8, wherein the first folding unit includes a first folding member pressing the first side surface part to fold the first side surface part, and a drive device to move the first folding member in the upward and downward directions.

10. The automatic packing apparatus according to claim 8, wherein the side surface bonding unit further includes a pressing unit configured to move in the upward and downward directions to press the upper surface of the packing box.

11. The automatic packing apparatus according to claim 8, wherein the side surface bonding unit further includes adhesive spray units configured to spray an adhesive to at least one of the first side surface part and the second side surface part.

12. The automatic packing apparatus according to claim 11, wherein each of the adhesive spray units includes a spray nozzle configured to spray the adhesive, and a movement member connected with the spray nozzle to move the spray nozzle in the leftward and rightward directions.

13. The automatic packing apparatus according to claim 1, further comprising a box stop unit configured to move in the upward and downward directions to support the rear surface of the packing box, the box stop unit configured to set a stop position of the packing box.

14. The automatic packing apparatus according to claim 1, further comprising box alignment units to respectively align both side surfaces, of the packing box facing each other, the alignment units configured to align both the side surfaces during bonding the at least one unbonded side surface of the packing box.

15. An automatic packing method comprising:

preparing a vertical stack of boxes, each box including upper and lower surfaces and at least one unbonded side surface;

moving the box stack vertically upwards to an upper position to insert a product into a packing box, the packing box being the uppermost box of the box stack;

forming an inlet at the upper position, through which the product is inserted into the packing box, on at least one unbonded side surface of the packing box by lifting up the upper surface of the packing box;

transferring the product to the inlet at the upper position; and bonding the at least one unbonded side surface of the packing box including the inlet.

16. The automatic packing method according to claim 15, further comprising:

placing the box stack on a bogie and moving the box stack in an upward direction by raising the bogie using a lift.

17. The automatic packing method according to claim 15, further comprising:

forming the inlet by lifting up the upper surface of the packing box using members detachably attached to the upper surface of the packing box.

18. The automatic packing method according to claim 15, further comprising:

conveying the product into the inlet by a conveyer belt.

19. The automatic packing apparatus method according to claim 15, further comprising:

providing the at least one unbonded side surface of the packing box including a first side surface part connected with the upper surface of the packing box and a second side surface part connected with the lower surface of the packing box;

spraying an adhesive on at least one of the first side surface part and the second side surface; and bonding the first side surface part and the second side surface part using the adhesive by folding the first side surface part downwards and folding the second side surface parts upwards.

20. The automatic packing method according to claim 15, further comprising:

transferring the packing box including the product therein out of the box stack before the at least one unbonded side surface of the packing box is bonded.

21. An automatic packing apparatus configured to automatically pack products in vertically stacked boxes including upper and lower surfaces and wherein at least one side surface of each box is not bonded, the apparatus comprising:

a frame forming a space in which a product is packed;

at least one box supply unit configured to supply the box stack to the frame and configured to move the box stack vertically upwards to an upper position so that the product is inserted into a packing box, the packing box being the uppermost box of the box stack;

an inlet formation unit fixed to the frame, the inlet formation unit configured to lift the upper surface of the packing box to form an inlet at the upper position through which the product is inserted into the packing box, the inlet being on at least one unbonded side surface of the packing box;

a product supply unit configured to transfer the product to the inlet at the upper position; and a side surface bonding unit fixed to the frame and configured to bond the at least one unbonded side surface of the packing box, the at least one unbonded side surface of the packing box including the inlet and the packing box including the product inserted therein.

* * * * *